United States Patent [19]

Singenberger et al.

[11] 4,280,394

[45] Jul. 28, 1981

[54] MARINE FIRING WEAPON

[75] Inventors: Emil Singenberger, Ennetbürgen; Heinz Wilhelm, Lucerne, both of Switzerland

[73] Assignee: Werkzeugmaschinenfabrik Oerlikon-Bührle AG, Zürich, Switzerland

[21] Appl. No.: 956,221

[22] Filed: Oct. 30, 1978

[30] Foreign Application Priority Data

Nov. 4, 1977 [CH] Switzerland ..... 13432/77

[51] Int. Cl.[3] ..... F41F 23/00

[52] U.S. Cl. ..... 89/37 A; 89/41 D

[58] Field of Search ..... 89/37 R, 37 A, 37 G, 89/41 R, 41 D, 41 AA

[56] References Cited

U.S. PATENT DOCUMENTS

| | | | |
|---|---|---|---|
| 2,164,722 | 7/1939 | Sanders | 89/37 G |
| 2,978,961 | 4/1961 | Warren | 89/37 A |

*Primary Examiner*—Stephen C. Bentley

*Attorney, Agent, or Firm*—Werner W. Kleeman

[57] ABSTRACT

A marine or naval firing weapon which is particularly suitable for fighting targets in zenith and additionally is capable of taking into account the movements of the vessel during aiming. The firing weapon comprises a first alignment axis which does not extend in zenith and a second alignment axis arranged at right angles to the first alignment axis. A support is mounted to be rotatable about the first alignment axis and a firing weapon is mounted upon the support for rotation about the second alignment axis. The first alignment axis does not extend into the target area and is inclined with respect to the horizon.

5 Claims, 4 Drawing Figures

MARINE FIRING WEAPON

BACKGROUND OF THE INVENTION

The present invention relates to a new and improved construction of marine or naval weapon comprising a first alignment axis which does not extend in zenith, a second alignment axis arranged essentially at right angles to the first alignment axis, a support rotatably mounted about the first alignment axis, and a firing weapon which is mounted upon the support for rotation about the second alignment axis.

When utilizing such naval weapons for fighting targets in the air and upon the water, i.e., on the horizon, different problems arise.

(a) The rolling and pitching or banking of the vessel renders aiming of the weapon more difficult. Therefore, special measures are required for eliminating the effects of such pitching and banking movements of the vessel upon the weapon.

(b) In the case of weapons whose one alignment axis protrudes into the zenith, during fighting of targets which are not located in the zenith, there must be employed large acceleration forces for repositioning the weapon.

Now with a heretofore known weapon of this type, as taught for instance in West German Patent Publication No. 329,461, there is provided an apparatus for eliminating the effect of the rolling and pitching movements of the vessel, wherein the weapon barrel is rotatably mounted in two horizontal axes disposed orthogonally with respect to one another and which are pivotable about a vertical axis.

With this known equipment the horizontal axis disposed at right angles to the trunnion bearing axis is located in the elevation plane of the weapon. Consequently, for each position of the weapon the elevation plane is rotatably and vertically adjustable about this axis in order to compensate for the pitching movement of the vessel. However, the alignment or aiming of the weapon, with this prior art weapon, is accomplished about the vertically disposed pivot axis which is exactly aligned in zenith.

This heretofore known arrangement is associated with the drawback that aiming is exceedingly rendered more difficult in zenith and in its surroundings. Tracking of a target moving through the zenith requires large changes in azimuth. As long as the weapon barrel is disposed approximately parallel to the perpendicular dispositioned azimuth axis, there is practically not possible any exact aiming. This is particularly disturbing in the case of naval weapons, since, along with the movements of the vessel there is also moved the vertical azimuth axis, and hence, there is additionally rendered more difficult as a result aiming at the region of the zenith.

The aforementioned large changes of the azimuth with large movements of the target at the region of the zenith additionally requires large acceleration forces, and therefore, large drive or power requirements in order to reposition the weapon.

SUMMARY OF THE INVENTION

Hence, with the foregoing in mind it is a primary object of the present invention to provide a new and improved construction of marine firing weapon which is not associated with the aforementioned drawbacks and limitations of the prior art proposals.

Another and more specific object of the present invention aims at providing a new and improved construction of a marine or naval firing weapon, which is capable of taking into account the movements of the vessel during aiming, which is especially suitable for fighting targets located in zenith, and does not require any large drive power during repositioning of the weapon.

Now in order to implement these and still further objects of the invention, which will become more readily apparent as the description proceeds, the weapon of the present development is manifested by the features that the first alignment axis is inclined with regard to the horizon in such a manner that it does not extend into the target area or region.

From U.S. Pat. No. 2,978,961 there are already known to the art naval weapons wherein one pivot axis does not extend in zenith, the second pivot axis is arranged at right angles to the first pivot axis, and both pivot axes form the alignment or aiming axes.

Yet, this heretofore known weapon system is associated with the drawback that the first pivot axis is horizontally arranged, so that during fighting of targets appearing at the horizon in the direction of such pivot axis the same difficulties arise as when fighting targets in zenith in the event, as mentioned, the first pivot axis is vertically arranged.

Therefore, to avoid this shortcoming the invention proposes arranging the first pivot axis such that it does not extend into the target region or area.

BRIEF DESCRIPTION OF THE DRAWINGS

The invention will be better understood and objects other than those set forth above, will become apparent when consideration is given to the following detailed description thereof. Such description makes reference to the annexed drawings wherein throughtout the various Figures there have been used for the different embodiments generally the same reference characters to denote the same or analogous structure, and wherein.

DETAILED DESCRIPTION OF THE PREFERRED EMBODIMENTS

Figure 1:
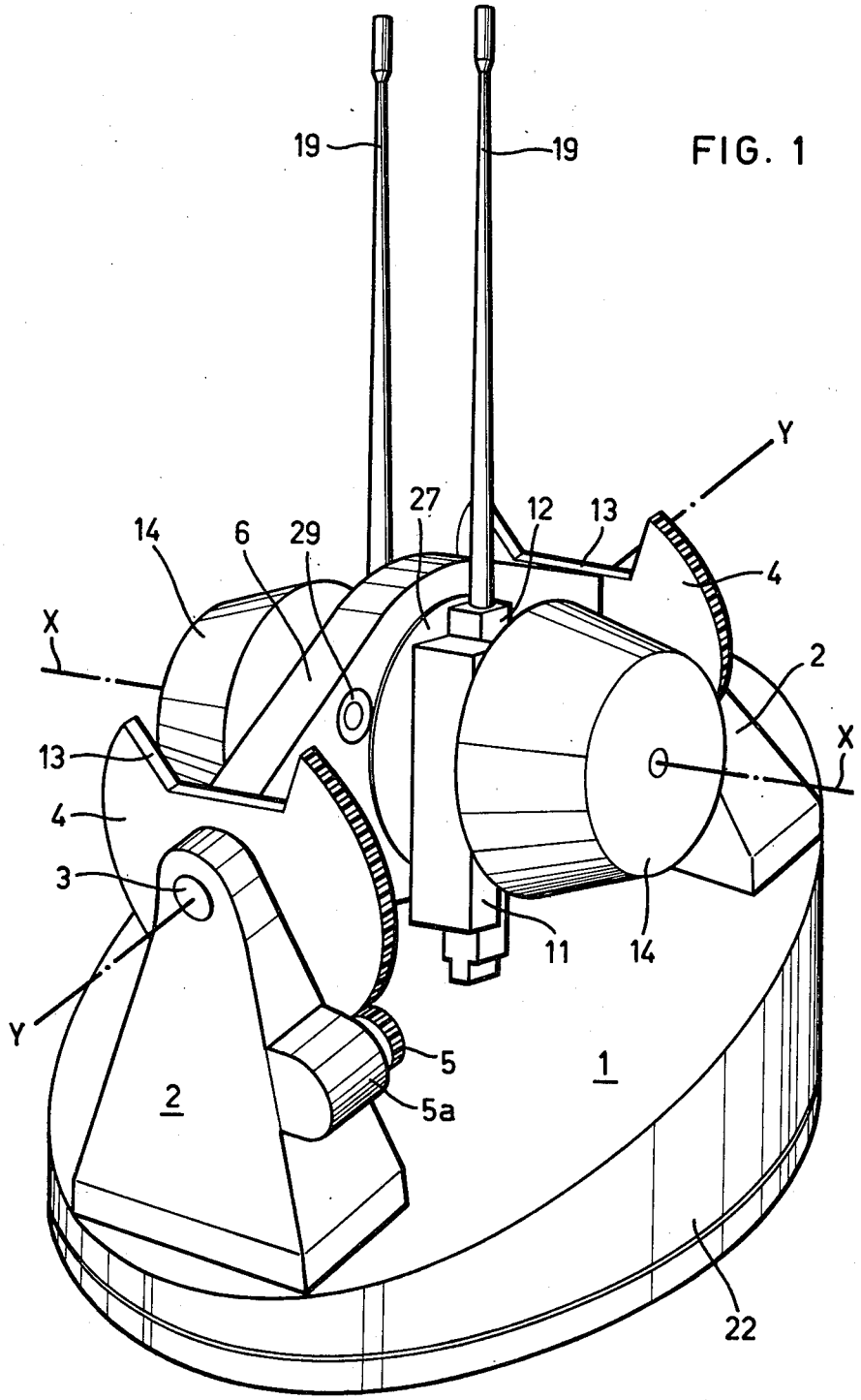
FIG. 1 is a perspective view of a weapon constructed according to a first exemplary embodiment of the invention.

Describing now the drawings, according to the showing of the marine or naval firing weapon of FIG. 1, there are erected two supports or support members 2 upon a surface 1 of a socket or pedestal 22, this surface 1 being inclined with respect to the horizon. Between these supports 2 there is pivotably mounted a support or carrier 6 for pivotal movement about a stationary alignment or aiming axis Y—Y. The support or support means 6 possesses at each of its two ends a respective axle journal 3 or equivalent structure which protrude into the supports 2 and are coaxially arranged with respect to the alignment axis Y—Y. The support 6 furthermore possesses at both ends a respective toothed segment 4 which meshes with a related pinion 5. Each pinion 5 is driven by a suitable drive motor 5*a* secured to the supports 2, in order to rock or pivot the support or carrier 6 about the alignment axis Y—Y.

A gear 27 is rotatably mounted in the support 6. Gear 27 meshes with a pinion 29. This pinion 29 is driven by a suitable motor which is not particularly shown in the drawing, in order to rotate the gear 27 about a second alignment or aiming axis X—X. To both sides of the gear 27 there is attached a respective gun cradle 11. Upon each cradle 11 there is mounted a recoil weapon or gun 12. Both of the alignment axes X—X and Y—Y intersect one another at right angles. The toothed segments 4 each have a cut-out or recess 13 which determines the range of pivotal movement of each weapon 12 secured to its cradle or gun mount 11 about the alignment axis X—X. Furthermore, a drum magazine 14 for cartridges is attached at the gun mount or cradle 11 of each weapon 12, each such drum magazine 14 likewise being rotatably mounted about the alignment axis X—X. Instead of using drum magazines 14 there also can be provided other types of ammunition magazines. Ammunition magazines suitable for use with the weapons of the invention have been disclosed, by way of example, in Swiss Pat. No. 379,969, to which reference may be readily had and the disclosure of which is incorporated herein by reference.

Figure 2:
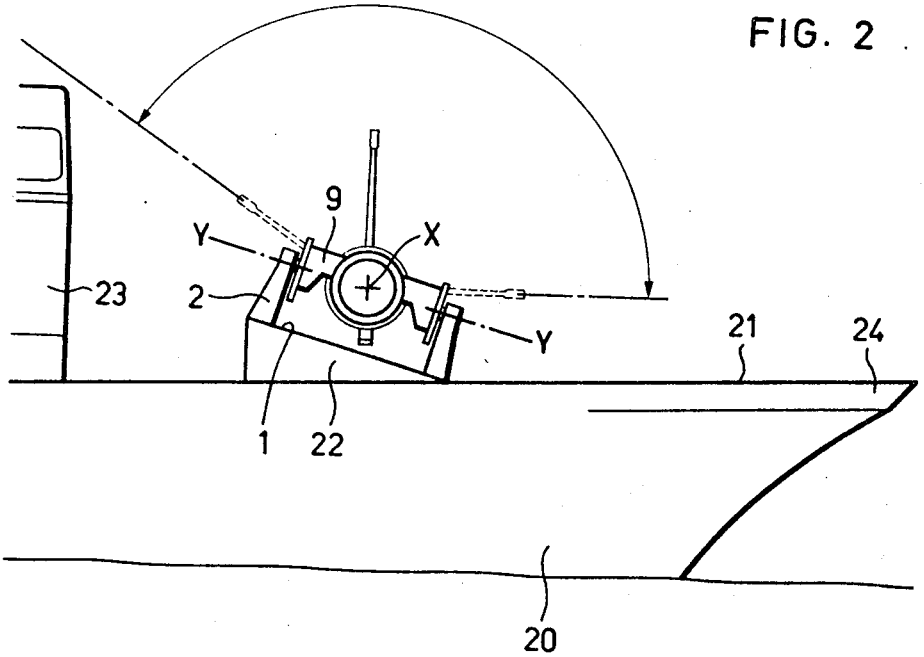
FIGS. 2 and 4 schematically illustrate the front deck of a vessel equipped with a weapon.

According to the showing of FIG. 2 the described weaponry is located for instance at the front deck 21 of a vessel or ship 20. This socket or pedestal 22 of the weapon system is attached to such front deck 21. Such socket 22 has, as mentioned, the surface 1. This surface 1 is inclined towards the bow 24 in the lengthwise direction of the vessel 20 and carries the supports 2 of the weapon. Due to this inclination of the surface 1 also the alignment axis Y—Y is inclined with respect to the ship's deck 21. The angle of inclination can amount to about 20° in the exemplary embodiment.

The barrels 19 of the firing weapons 12 can be rocked through an angle of about 160° about the alignment axis X—X. Limitation of such angular rocking or pivotal motion, as mentioned, is undertaken by the cutouts or recesses 13 of both toothed segments 4. This means that the minimum angle between the barrel axis and the alignment axis Y—Y amounts to about 10° in the one and in the other direction. The support 6 can be rocked through an angle of about 270° about the alignment axis Y—Y.

If the weapon barrels 19 are rocked about the alignment axis X—X into their one or other terminal position and thereafter rocked or pivoted through the aforementioned angle of about 270° about the alignment axis Y—Y, then the weapon barrels 19 describe two cone shells or jackets, the apexes of which are disposed along the alignment axis Y—Y and surround the same. A target cannot be hit within this cone. However, as apparent from the showing of FIG. 2, within this region there are located the ship's superstructure 23 and the ship's bow 24, so that anyway within such cone firing cannot take place.

On the other hand, the described weapon system is particularly suitable for fighting targets which are located in zenith, since in this region the weapon can be readjusted with appreciably smaller pivotal movements to aim at a target moving within the zenith than such is possible with conventional weapons whose azimuth is directed towards the zenith.

Figure 3:
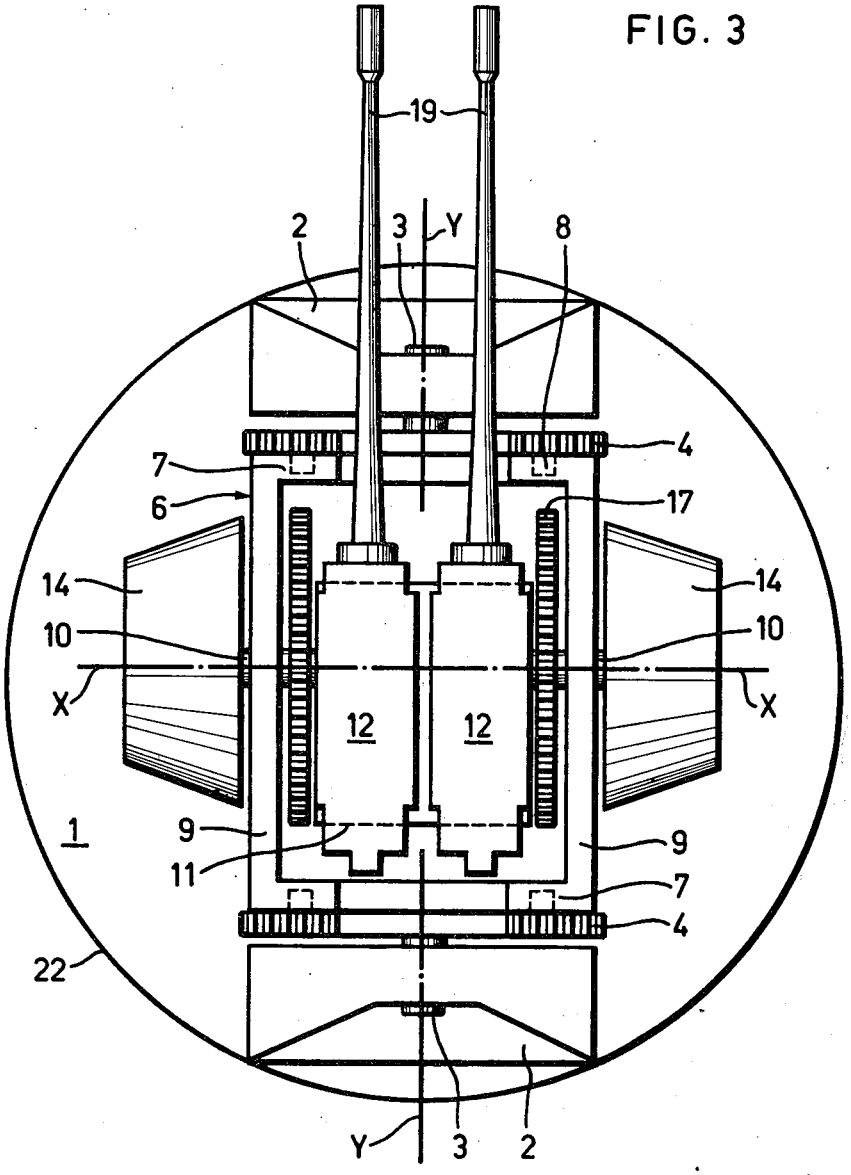
FIG. 3 illustrates a second exemplary embodiment of marine or naval or firing weapon in plan view.

The exemplary embodiment illustrated in FIG. 3 differs from the described first exemplary embodiment essentially by virtue of the particular construction of the support 6. Between both of the supports 2 there is pivotably mounted for movement about the stationary alignment axis Y—Y the frame-like support or carrier 6. This frame-shaped support or carrier 6 possesses two transverse beams 7 which are interconnected by the side beams 9. Two toothed segments 4 are secured by bolts 8 or equivalent fastening devices at the transverse beams 7. These toothed segments 4 serve to rotate the support 6 about the alignment axis Y—Y in the described manner. Attached to the transverse beams 7 are the bearing journals or pins 3 which protrude into the supports 2 and are rotatably mounted therein. In the side beams 9 there are rotatably mounted the trunnions or pivot pins 10 which are attached so as to protrude to both sides of the gun mounts or cradles 11. At the outer sides of the gun mounts or cradles 11 there is arranged a respective toothed segment 17 which, in the described manner, serves for pivoting or rocking the cradles 11 about the alignment axis X—X. The socket or pedestal 22 having the inclined surface 11 can be rotatably mounted about a vertical axis.

Figure 4:
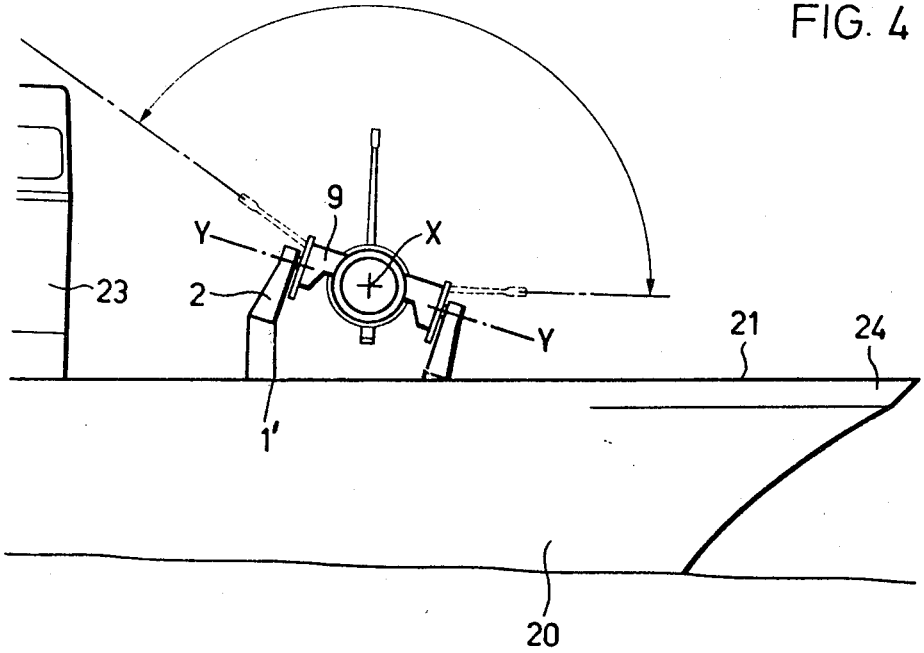

According to the showing of FIG. 4 both of the supports or support members 2 are attached to a horizontal platform 1' of the ship's deck 21, and both supports 2 are of different length.

While there are shown and described present preferred embodiments of the invention, it is to be distinctly understood that the invention is not limited thereto, but may be otherwise variously embodied and practiced within the scope of the following claims. Accordingly,

We claim:

1. A marine weapon system comprising:

means defining a first alignment axis which does not extend into the zenith;

means defining a second alignment axis which is arranged essentially at right angles to the first alignment axis;

support means mounted to be rotatable about the first alignment axis;

firing weapon means rotatably mounted at said support means for rotatable movement about said second alignment axis;

said first alignment axis being inclined with respect to the horizon such that it does not extend into a target region of the firing weapon means;

two support members for mounting said support means defining an inclined support;

said inclined support defined by said support means being arranged between said two support members and rotatably mounted at said two support members;

a substantially horizontal platform at which there are arranged said two support members; and both of the support members arranged at said substantially horizontal platform being of different length.

2. The marine weapon system as defined in claim 1, wherein:

said first alignment axis is inclined such that it at least is directed in one direction towards the contour of the vessel.

3. The marine weapon system as defined in claim 1, wherein:

said first alignment axis is inclined such that it at least is directed in one direction towards the direct surroundings of the vessel.

4. The marine weapon system as defined in claim 1, further including:

first drive means for rotating said support means about said first alignment axis; and second drive means for rotating said firing weapon means about said second alignment axis.

5. A marine weapon system having a target region, wherein the center of said target region is at a predetermined angle from the zenith, comprising:

means for defining a first alignment axis inclined with respect to the horizon such that is does not extend into said target region of the firing weapon system;

means for defining a second alignment axis which is arranged essentially at right angles to the first alignment axis;

a carrier mounted to be rotatable about the first alignment axis;

first drive means for rotating said carrier about said first alignment axis;

firing weapon means, mounted at supports, for rotating about said second alignment axis;

second drive means for rotating said firing weapon means about said second alignment axis;

a substantially horizontal deck at which there is arranged an inclined platform;

said supports being arranged on said inclined platform and being of the same length;

whereby one edge of the target region is defined by the horizon and the other edge of the target region is defined by a predetermined angle above the first alignment axis; and whereby the part of the target region defined by the first alignment axis is greater than 90° but less than 180°.

* * * * *